US005802802A

United States Patent [19]

Wegler

[11] Patent Number: 5,802,802

[45] Date of Patent: Sep. 8, 1998

[54] ARRANGEMENT AT A BEAM OR BUILDING ELEMENT AND A MOULD FOR MAKING A BEAM OR BUILDING ELEMENT

[75] Inventor: George Wegler, Vaxholm, Sweden

[73] Assignee: Resaro AB, Vaxholm, Sweden

[21] Appl. No.: 583,024

[22] PCT Filed: Jul. 19, 1994

[86] PCT No.: PCT/SE94/00700

§ 371 Date: Jan. 19, 1996

§ 102(e) Date: Jan. 19, 1996

[87] PCT Pub. No.: WO95/03461

PCT Pub. Date: Feb. 2, 1995

[30] Foreign Application Priority Data

Jul. 19, 1993 [SE] Sweden ..... 9302446

[51] Int. Cl.[6] ..... E04C 3/20; B22O 19/02

[52] U.S. Cl. ..... 52/693; 52/724.2; 52/724.3; 249/95; 249/96

[58] Field of Search ..... 52/729.2, 724.2, 52/724.3, 724.5, 414, 693; 249/90, 95, 94, 96, 97, 160, 83; 264/275, 277

[56] References Cited

U.S. PATENT DOCUMENTS

| | | | |
|---|---|---|---|
| 893,792 | 7/1908 | Gabriel | 52/724.2 |
| 3,036,676 | 5/1962 | Potzsch | 52/693 |
| 4,185,423 | 1/1980 | Gutierrez . | |
| 4,660,346 | 4/1987 | Burger et al. | 52/693 |

FOREIGN PATENT DOCUMENTS

| | | | |
|---|---|---|---|
| 94038 | 6/1969 | France | 52/724.2 |
| 2 459 857 | 6/1980 | France . | |
| 543900 | 7/1957 | Italy | 52/724.2 |
| 450 135 | 6/1987 | Sweden . | |
| 487319 | 4/1970 | Switzerland | 52/724.2 |
| WO 82/02916 | 9/1982 | WIPO . | |
| WO 92/12303 | 7/1992 | WIPO . | |
| WO 93/11323 | 6/1993 | WIPO . | |

*Primary Examiner*—Michael Safavi

*Attorney, Agent, or Firm*—Jacobson, Price, Holman & Stern, PLLC

[57] ABSTRACT

A web for trusses, trusses with at least one chord including a cast slab and also chords for a slab in a cast member, manufactured from bar, wire or strip material, which like diagonals in a lattice girder are inclined in relation to the longitudinal direction of the chord, fastened to the chords or to the chord and slab, respectively.

3 Claims, 13 Drawing Sheets

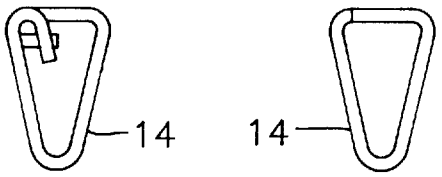
FIG. 16B
FIG. 16C
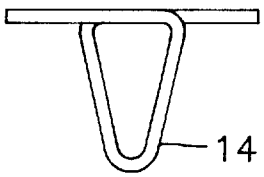
FIG. 16D
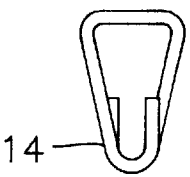
FIG. 16E
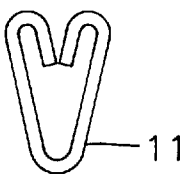
FIG. 16F
FIG. 17B
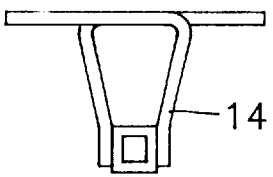
FIG. 17C
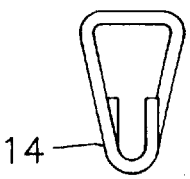
FIG. 17D
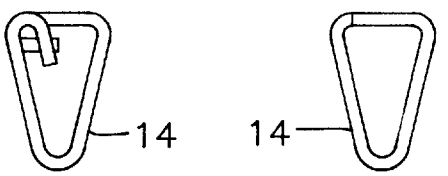
FIG. 18B
FIG. 18C
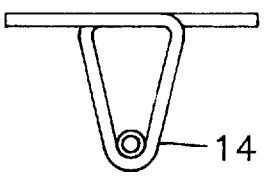
FIG. 18D
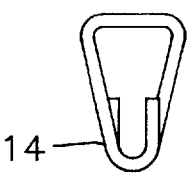
FIG. 18E
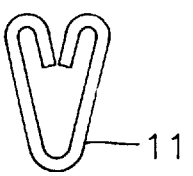
FIG. 18F

ARRANGEMENT AT A BEAM OR BUILDING ELEMENT AND A MOULD FOR MAKING A BEAM OR BUILDING ELEMENT

FIELD OF THE INVENTION

Arrangement for trusses with open web, trusses of the type with two chords, trusses of the type with two chords with at least one cast chord, and also chords for a slab of a cast member with an open web of a bar, wire or strip material with various types of arrays, fastened to the chords or to the chord and the slab, respectively.

BACKGROUND OF THE INVENTION

As companies producing pre-cast concrete are provided with widely differing equipment and capability to produce members of this kind, a number of varieties as regards web design is required. These truss webs have been developed in order to facilitate manufacture with a reasonable financial investment, but are also adapted to cast chords as well as chords made from steel tubing.

The invention is a development of a truss or a truss component or a member possibly to be cast with open web of wires or strip material bent to a zig-zag or zig zag resembling array according to Swedish patent SE 450135 and a further development of Swedish patent SE 466860 referring to a cast member consisting of a slab with strengthening chords, as well as PCT Patent Application PCT/SE92/00810 published as WO 93/11323, regarding trusses with single or double chords.

The chord of the cast member and the double chord trusses are provided with a chord with a web that is mainly bent to a zig-zag array, of which one configuration item 10 (with reference to FIGS. 1 to 3 in SE 466 860 ), has been given a new, different design in order to facilitate simultaneous casting of a chord and a slab.

It is desirable to be able to cast the chords at the same time as the member slab in order to avoid unnecessary handling caused by heavy pre-cast chords and in order to speed up the manufacturing process.

This invention indicates a solution to the above problem.

SUMMARY OF THE INVENTION

Today it is desired to manufacture members of large spans without intermediate supports, with the slab facing upwards and the chords below the slab.

The chords will in this case be subjected to tensile forces only, and because of this it is desired to use materials, e.g., steel sections, which can effectively take care of such forces. A web made from wire should then be provided with bends adapted to the shape of the chord at the point of connection, and the web can be fastened by means of a suitable method, e.g. welding.

Crosswise arranged bends of the webs at the connection to a cast slab or a chord have been subjected to tests on prototypes and show excellent properties as regards member performance, particularly as there is a possibility to provide the connection with longitudinal reinforcement and anchor bars in parallel with the main forces, without having to connect web and bars by welding, for example.

It is, however, difficult to manufacture long webs in one piece for the large spans and member depths in question. Fairly robust webs are required in these structures at these spans, in order to attain adequate stability, for example bar sizes of 10 to 12 mm diameter. Most machines can manage 8 mm diameter and manufacture webs bent in one plane. The machines are too expensive, neither are they available on the market, and development of new machines is too expensive for the time being. The invention provides a solution to this problem.

Examples of technologies known today through patents are given below.

As regards U.S. Pat. No. 4,185,423, designs are illustrated, constructed of webs bent in one plane where the web is welded to chord of steel sections. When embedded in a slab, these chords are provided with such a welded bar in order to obtain fully satisfactory anchorage. Test results indicate much improved performance of perpendicular bends when cast into a slab and facilitate slimmer dimensions in the structures, e.g. a thinner slab. However, in the invention the bends of the web are arranged perpendicular or oblique when embedded in a chord or a slab.

As regards WO 82/02916, a web with bends in one plane is indicated. The same comments as regards the joint apply equally here, as discussed previously. However, in the invention the bends of the web are at right angles or oblique. As regards patent SE 466860, the present invention seems at first to be very similar to web 10 in patent SE 466860 (refer to FIGS. 1 to 4). The new inventive web can, however, be otherwise utilized and lacks web bends bent in one plane, which is essential to the performance of the joint. It also differs from the former so far as the web is not bent in the middle but is bent on both sides at the ends.

The design is, of course, somewhat complicated and, furthermore, the web is shown as a continuous design, which is contrary to the intentions of this invention. It is, however, possible to manufacture, and a somewhat similar product is available on the market. It is used as a spacer between two thin concrete slabs in a sandwich structure where the space is utilized as a precast mould in a wall member cast in situ into a monolithic unit.

The present invention is different also to the above design as the invention refers to trusses with chords or cast members with chords. The turned down bend (see below) provides a perpendicular bend when cast into a chord or a slab, which is essential and conforms to the intentions of the inventions.

Despite the large amount of varieties of open webs disclosed by this and other inventions, the present variety of a web is still required because this web considerably facilitates the possibility to cast the chord as a monolithic unit at the same time, indeed in the same operation, as the slab of the member (see below).

It is also desired to obtain a more easily manufactured web made from small components and with perpendicular or oblique bends, facilitating casting of the chord and the slab simultaneously and in the same operation. There is a solution to this problem.

The intention of this invention is to achieve as many as possible of the known properties of the above wire web but with a different design for facilitating manufacturing operations. The invention also provides possibilities for a few arrangements of the web diagonals which are not possible with long uninterrupted webs.

Another purpose of this invention is to provide extremely rational and economical manufacturing of high automation in order to cut prices. As the truss can be made very strong and light with a minimum of material, it should be possible to manufacture it at a low cost, which is important with consideration to exports.

At the same time, the purpose of the invention is to provide a satisfactory anchorage between a wire web and a chord and between a wire web and a cast chord or slab. It is above all the torsional movements at the bend, due to the direction of forces in the web wires, one tensioned and the other compressed, which attempt to wrench off the connection between the web and the chord, that have been considered. Trusses with webs bent in one plane are particularly sensitive to such torsion. The truss according to the invention, with its new design, provides a very strong and light structure, which at the same time as it provides a load bearing function, it also functions as an installation space for wiring conduits and plumbing, central vacuum cleaning installations, etc. and as a suspension device for suspended ceilings or installation equipment in a crawl space.

The invention also makes it possible in a rational manufacturing process to provide a double web in order to improve the load bearing capacity without having to increase the size of the web wires.

Solution to the problem:

The task to achieve as many as possible of the above properties and to make the truss particularly strong and light, with minimum material and with a satisfactory connection between web wire and chord as well as between web wire and a cast chord or slab, has been solved by designing the web according to the following.

The basic material may be a bar, wire, tube or strip material, straight or coiled to a large diameter, cut to suitable lengths. The bar may possibly be provided with end hooks at both ends. These can be in the same plane, bent towards each other or in same direction into an S-shape, or in different planes.

The web is bent in one plane when fastened to metal chords which are not of a round shape, and with perpendicular or oblique bends when embedded into a chord or a slab. The end of the web are made straight or bent so that they become longitudinal at fastenings to metal chords and perpendicular or oblique when embedded in a cast chord or a slab.

More bending patterns providing a zig zag array and perpendicular bends for embedding are described latter. These solutions have in common that they do not subject the chord to torsion, when seen in cross section, when the truss is subjected to loading.

The solution, according to the invention, to cast the chords at the same time as, for example, a cast slab of a member, or both chords of a truss with a wider bottom chord, is to arrange the chord moulds at a distance above the slab. If there are openings between the moulds, in the space between the upper chords, the concrete can, after filling the top chord mould, pour down and fill the mould of the slab or the bottom chord respectively. When a vibrating table form is used, also the top moulds will be vibrated. The entire member can thus be manufactured in one single operation.

The moulds can, for example, be divided into two halves, possibly with a seal between the halves. A resilient material can be attached to the bottom of the mould halves in order to obtain tightness around the web members. When the mould halves are pressed together, the resilient material will be compressed and shaped around the web wires. Examples of resilient materials are rubber or some kind of polymer of rubber-like properties. Another way to obtain tightness is to notch the contact surfaces of the mould halves, to arrange recesses for the web wires.

If the web wires in an open truss web are arranged in one plane at the sealing mould contact surfaces, it is realized that the mould components can be made straight and possibly flat at the joint, in which case truss web item (10) according to FIGS. 3 and 5 is required for this type of manufacture.

There is also another possibility with still another truss web (see reference numerals 6, 7, 8 and 9) according to FIGS. 21 and 22, manufactured from small components and with perpendicular or oblique bends facilitating casting of both the chords and the slab member at the same time and in the same operation.

At the same time, the web will also be fixed in the correct position and be firmly kept in position during casting and compaction by vibration. The truss moulds can be arranged as a jig assembled with truss web, reinforcement, etc. somewhere else and before casting. The jig can then be lifted onto the table form.

BRIEF DESCRIPTION OF THE DRAWINGS

FIGS. 16A–16F illustrate a perspective view of a supported structural floor member with cast chord (3) and sectional views of truss web Δ-bent shape (14), with short and long ends as well as end hooks. Also provided is a V-bent shape truss web with end hooks. The truss webs, perpendicular or oblique, are arranged into a zig zag array according to the invention.

FIGS. 17A–17D illustrates a pre-cast member with Δ-bent beam web member (14) according to the invention, including chords with flanges of metal, rectangular hollow sections or alternatively double metal L-sections. Metal flanges (2, 21, 22) of non-round cross section, with perpendicular or oblique inside bends (15) in the slab, with straight truss ends (19) are positioned in such a configuration that when seen in the longitudinal direction of the flange they create a zig zag array.

DETAILED DESCRIPTION OF THE PREFERRED EMBODIMENTS

A suggested method of manufacturing includes use of standard machines to form an inside bend to a web bent in one plane (18) with V- or V-like bends. The bends are placed perpendicular to the direction of extension of the flange and so that one, seen from the side, perpendicular or oblique part (15) of the web wire is created and placed so that the bends are mainly crosswise to the longitudinal direction of the chord and embedded in a somewhat wide chord or slab, with the ends fastened to chords (22) of double L-sections or rectangular hollow sections, with straight ends (19) so that the members, as seen in the longitudinal direction of the flange, form a unit with a zig-zag array.

Figure 1A:
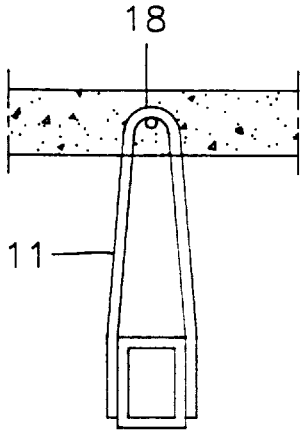
FIG. 1A illustrates a section of a chord with web bent in one plane (18) and V-shaped (11) according to the invention. A chord of steel is shown in double L-sections (22). Truss webs are arranged in a zigzag array so that the bends of the truss webs are placed perpendicular or oblique according to the invention.
Figure 1B:
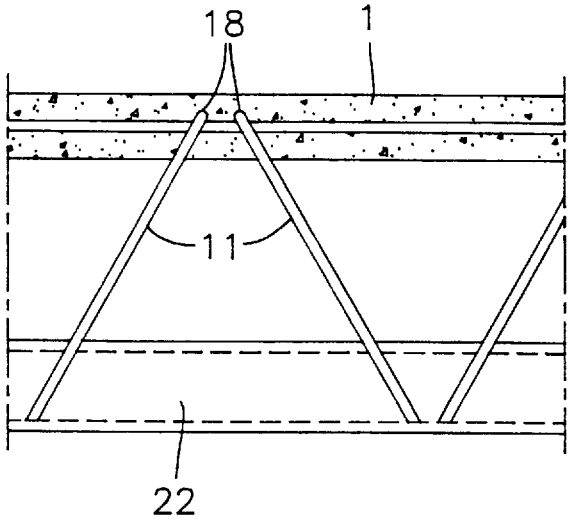
FIG. 1B illustrates a side view of a chord according to FIG. 1A.
Figure 2A:
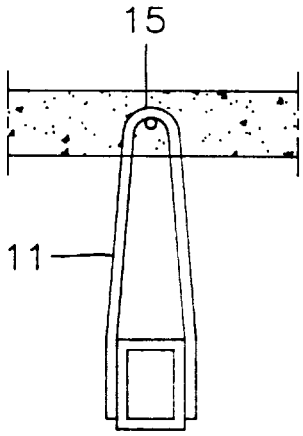
FIG. 2A illustrates a section of a chord with a V-bent web (11) with bends turned so that they are placed perpendicular or oblique (15) and in conformity with the invention. A chord is shown of double L-sections or rectangular hollow sections (22).
Figure 2B:
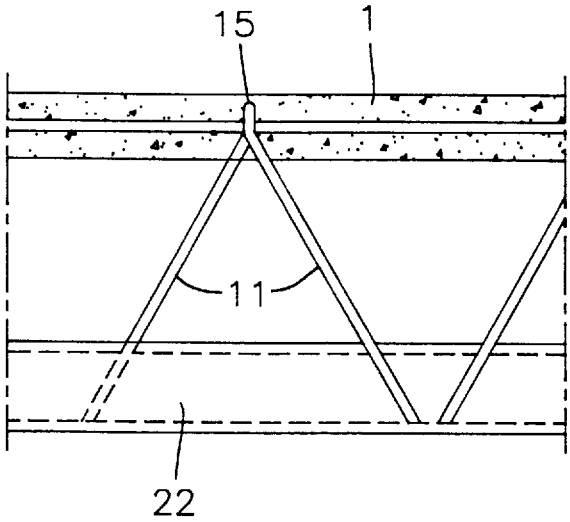
FIG. 2B illustrates a side view of a chord according to FIG. 2A.

FIG. 2 illustrates a web (11) that is V-bent. By means of standard machines a web bent in one plane is bent into V- or V-like bends. The ends are then bent or turned to the side in any direction along a bending axis which can be perpendicular to the direction of the chord so that a perpendicular or oblique part (15) of the web wire is created with straight ends (19). Furthermore, the web can be cut into suitable lengths. The bar is provided with end hooks (16; 17) at both ends. These can be bent in the same plane towards each other or in the same direction into an S-shape or in different planes. The web can be bent with a flat bend (18) or perpendicular or oblique bends (15) and, at least at the joint to metal chords, be bent in one plane along the chord.

Figure 7A:
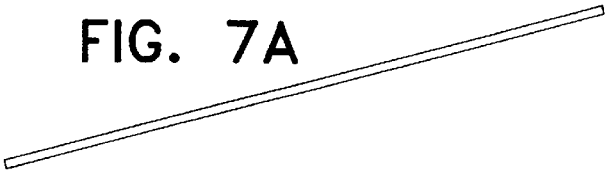
FIGS. 7A–7C illustrates perspective views of the manufacture of a V-bent web (11) with perpendicular or oblique ends hooks (16) according to the invention.
Figure 7B:
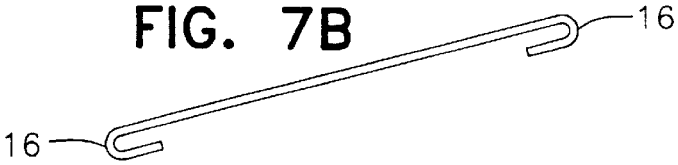
Figure 7C:
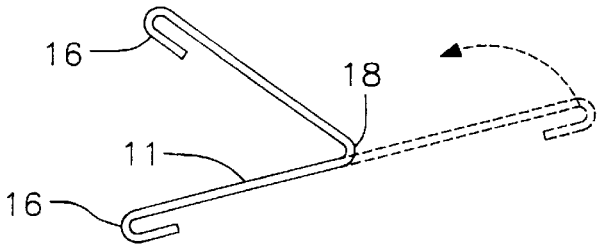

In one design the end hooks are bent towards each other and in the same plane. Then the bar is bent once again, in another plane, at the middle into a V-shape so that the end hooks will be mainly perpendicular or oblique (16). See FIG. 7. The flat bends are fastened in rows to the chord which can be made from steel, alternatively turned in one or the other direction, on each side of the flange in order to avoid eccentric loading. A reinforcement bar (28) can be placed inside the end hooks (16) to absorb forces and provide anchorage. The end hooks are embedded in the member slab (1) or in a cast chord (3). See FIGS. 4, 5, 6, and 10.

Figure 11:
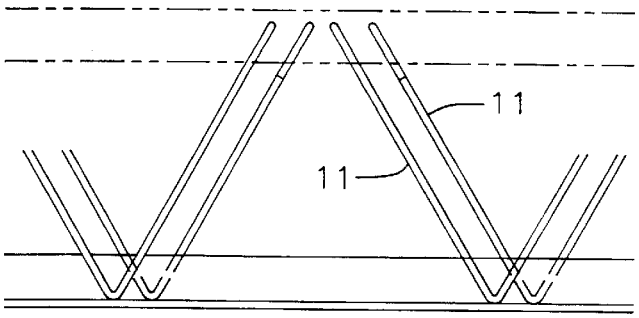
FIG. 11 illustrates a side view of a chord with V-bent webs (11) placed in pairs with perpendicular or oblique end hooks (16) according to the invention. A chord (21) of steel T-section shape is shown.

The V-bent web bars can be placed one after the other, possibly joined together at the end hooks so that a zig-zag array is created. Alternatively, the bars may be more widely spaced, or closer spaced in an X-array, or even closer spaced, also in pairs in such a way that a kind of double V-array, of double webs, is created in a zig-zag array. FIG. 11 illustrates a view of a chord with V-bent webs (11) with perpendicular end hooks (16) placed in pairs.

Figure 8A:
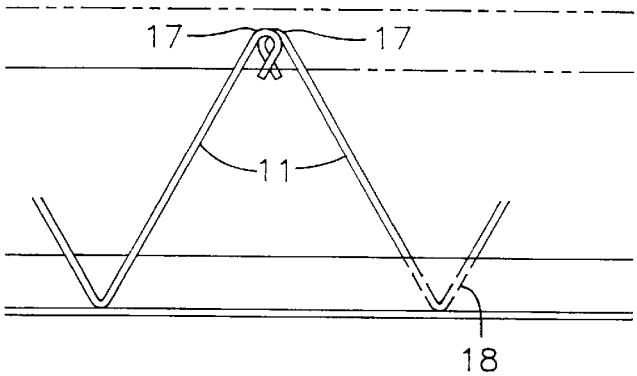
FIGS. 8A–8C illustrates a side view and section views of a chord with a V-bent web (11) with end hooks (17) bent in one plane according to the invention. A chord of steel T-section shape or double L-section shape is shown in FIGS. 8B and 8C, respectively.
Figure 8B:
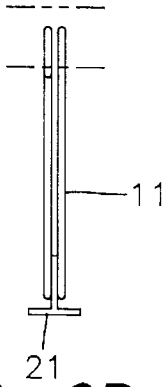
Figure 8C:
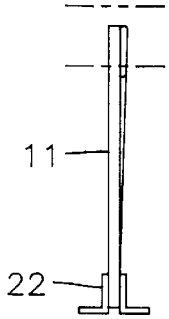

The web can also be bent with the end hooks in the same plane bent towards or away from each other, then bent in the middle into a V-shape with end hooks mainly flat. Also these web bars can be placed according to above but in this case also in truss chord metal flanges. FIG. 8 illustrates a view and sections of a chord with a V-bent web (11) with end hooks (17) bent in one plane according to the invention. Flange (21) of steel T-shape and double L sections (22).

Figure 9A:
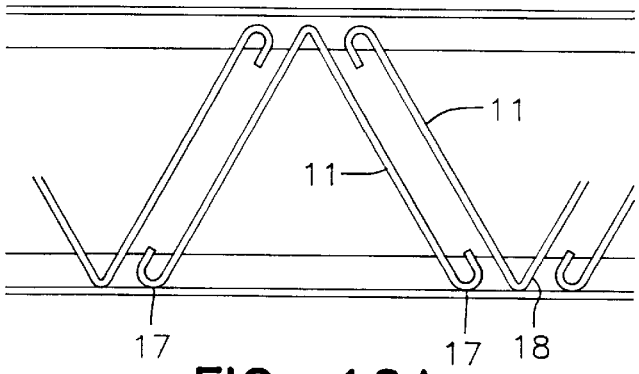
FIGS. 9A–9C illustrates a side view and section views of a truss with double chord flanges with V-bent web (11) with end hooks (17) bent in one plane according to the invention. Webs are placed opposite each other in pairs. Chords of steel T-section shape and double L-section shape are shown.
Figure 9B:
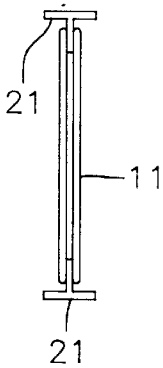
Figure 9C:
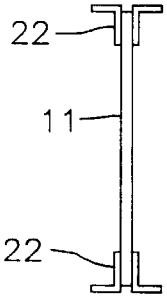
Figure 10A:
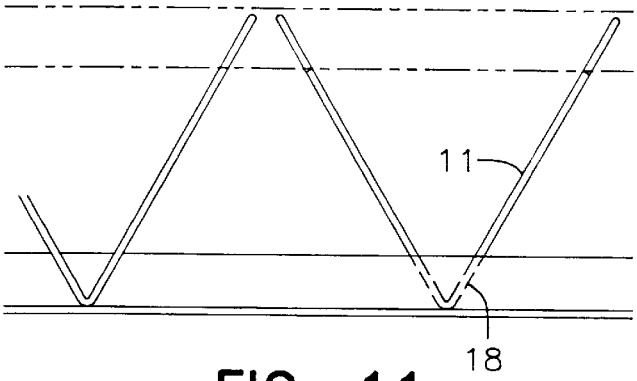
FIGS. 10A–10C illustrates a view and section views of a chord with V-bent web (11) with perpendicular or oblique end hooks (16) bent in one plane according to the invention. A chord (21) of steel T-section is shown.
Figure 10B:
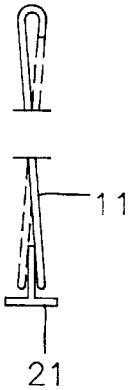
Figure 10C:
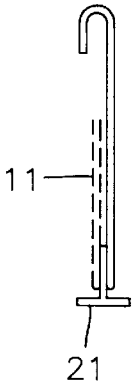

The webs can also be turned towards each other in the plane of the truss into a double W-pattern. FIGS. 9A–9C illustrate a view and sections of a truss with a V-bent web (11) with end hooks (17) bent in one plane. The webs are arranged opposite each other in pairs. Two types of the flanges (21) of steel of T-shape and double L sections (22) are shown.

Figure 12A:
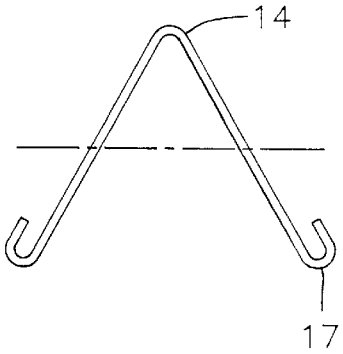
FIGS. 12A–12C illustrate the manufacturing operation as well as a side view and a section view of a W-bent web (12) with end hooks (17) bent in one plane according to the invention.
Figure 12B:
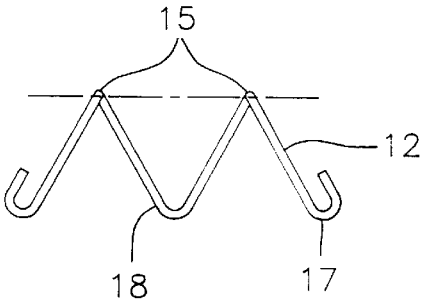
Figure 12C:
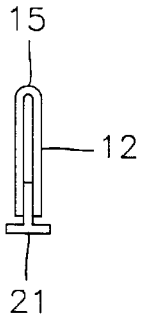

The web can also be bent with end hooks in the same plane bent towards each other, then bent in the middle in the same plane into a V-shape with end hooks mainly flat and then bent in the middle in a new plane into a W-shape. FIG. 12 illustrates a view of a manufacturing process for a W-bent web (12) with end hooks (17) bent in one plane and perpendicular or oblique web bends (15). The end hooks bent in one plane occur on the same side as the flat bend facilitating fastening to the chord, which will cause another weld, which could prove a disadvantage. Bending of the middle section also requires another type of bending machine.

Figure 13A:
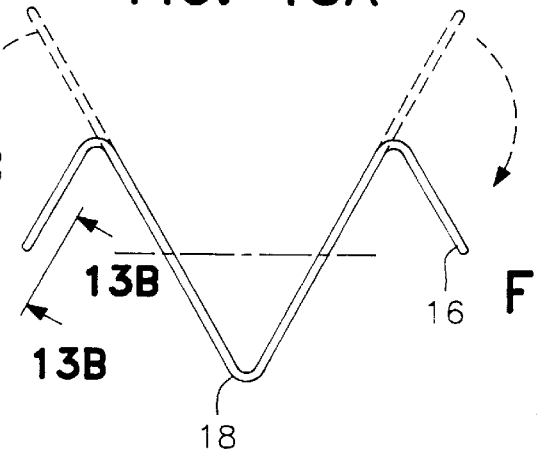
FIG. 13A illustrates the steps of manufacturing a VW-bent web (13) with perpendicular or oblique end hooks (16) according to the invention.
Figure 13B:
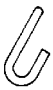
FIG. 13B is a side view looking in the direction of arrows 13B—13B.
Figure 14B:
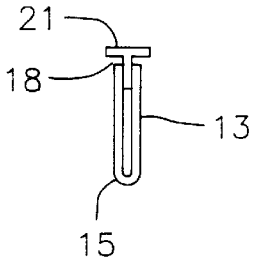
FIGS. 14A and 14B illustrate a side view and a section view of a complete VW-bent web (13) with perpendicular or oblique end hooks (16) according to the invention.
Figure 14A:
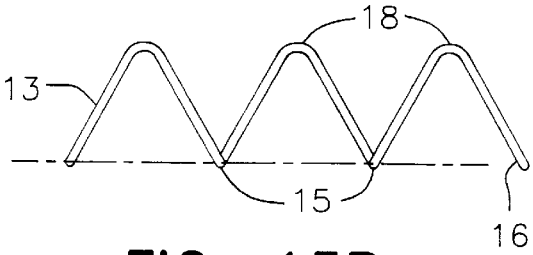
Figure 15E:
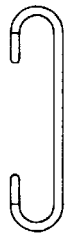
FIGS. 15A–15E illustrate views of a web (10) with (15A) VM-bent, (15B) V-similar M-bent, (15C) WM-bent (15D) L-bent, and section views (15E) C-bent and (15F) L-bent, according to the invention.
Figure 15B:
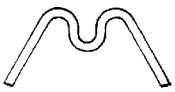
Figure 15C:
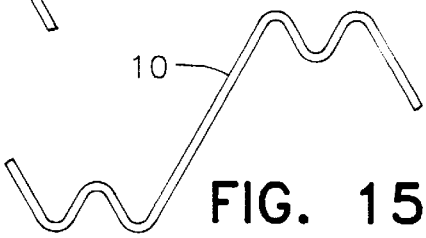
Figure 15A:
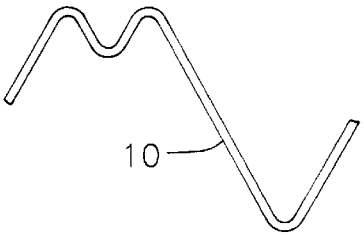
Figure 15F:
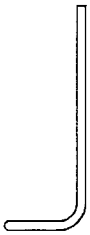
Figure 15D:
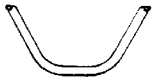
Figure 16A:
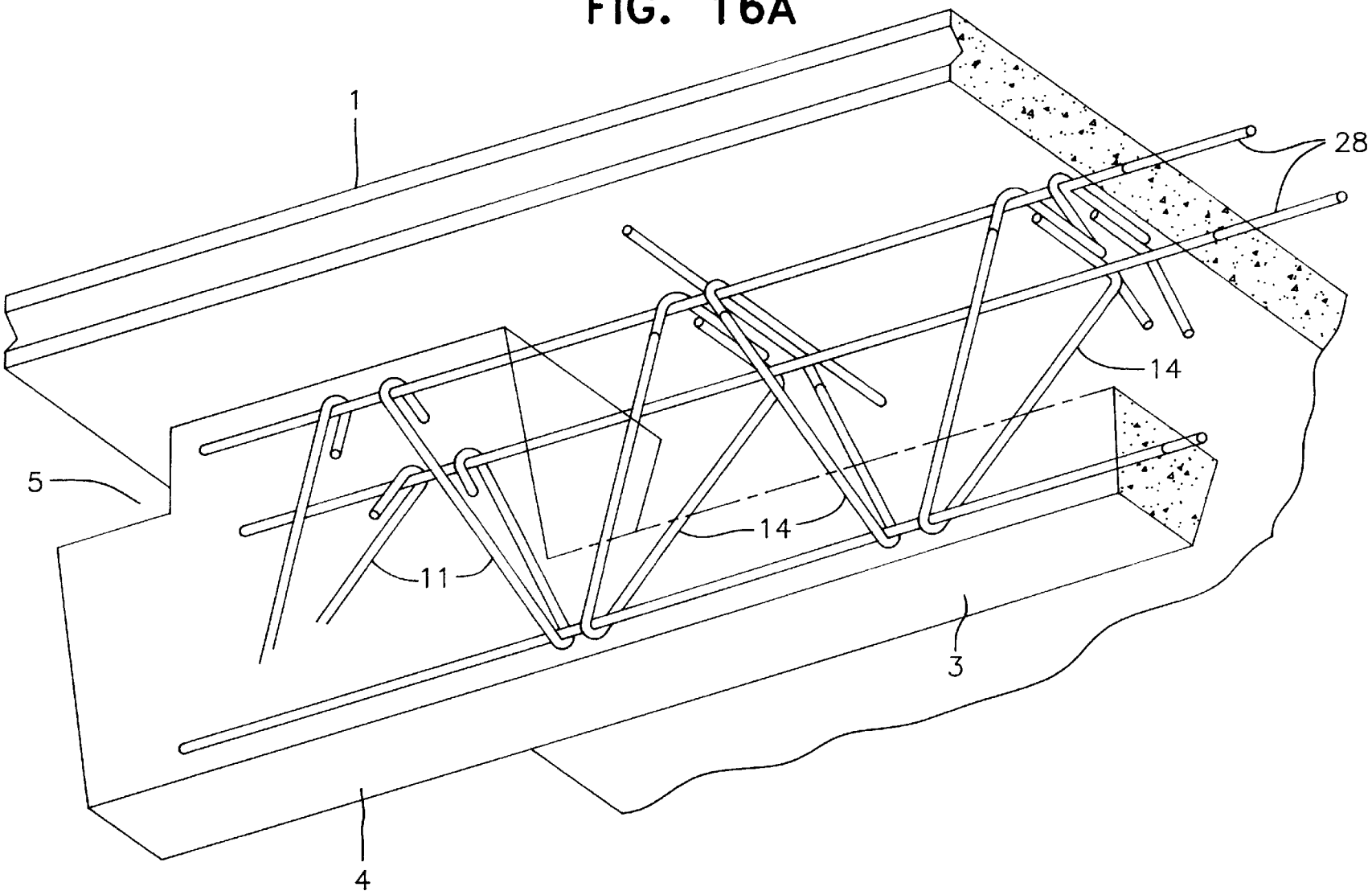
Figure 17A:
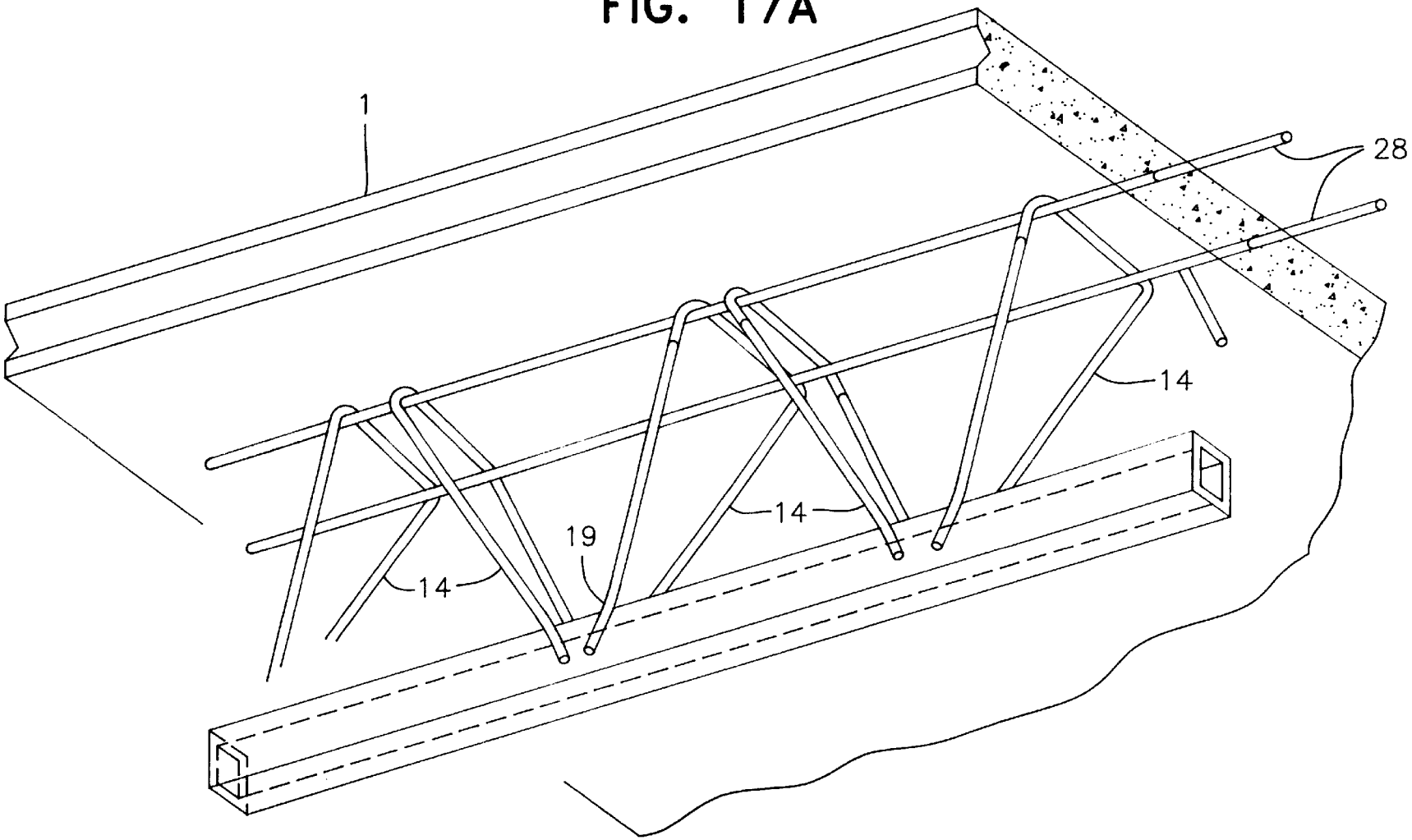
Figure 18A:
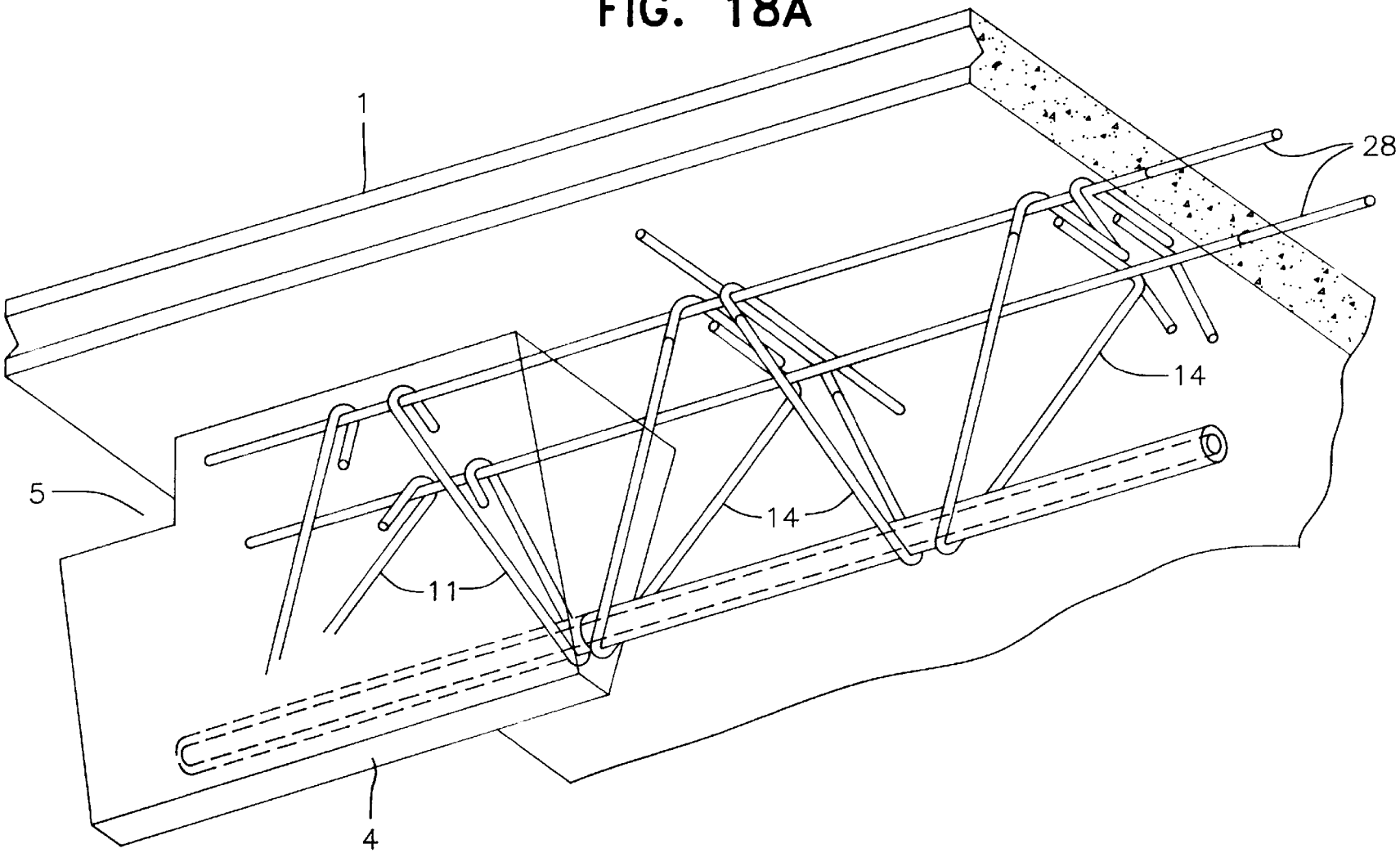
FIGS. 18–18E illustrates another example of a Δ-bent web member (14) according to the invention, in principle similar to FIG. 16, but with chords of steel, with a rounded cross section and round tubes shown.

The web can also be bent with end hooks in the same plane bent towards each other. The web is then bent in the middle into a V-shape with the end hooks mainly perpendicular oblique. Then the ends are bent in the same plane as the former bending at ⅙ distance points from the ends so that a kind of W-shape with a twice as deep middle part is created (13). Finally the V-shaped middle part is bent in the middle so that a VW-shaped web with flat bends (18) is created on the one side and perpendicular or oblique bends (15) on the other side (14). FIG. 13 illustrates a manufacturing process for a VW-bent web (13) with perpendicular or oblique end hooks (16).

No bending has been performed with longer shanks than the straight parts of the ready truss web, facilitating manufacturing operations on small premises using small machinery. The perpendicular or oblique end hooks end up at the side with perpendicular or oblique bends, and splicing takes place when they are embedded according to above.

Figure 3:
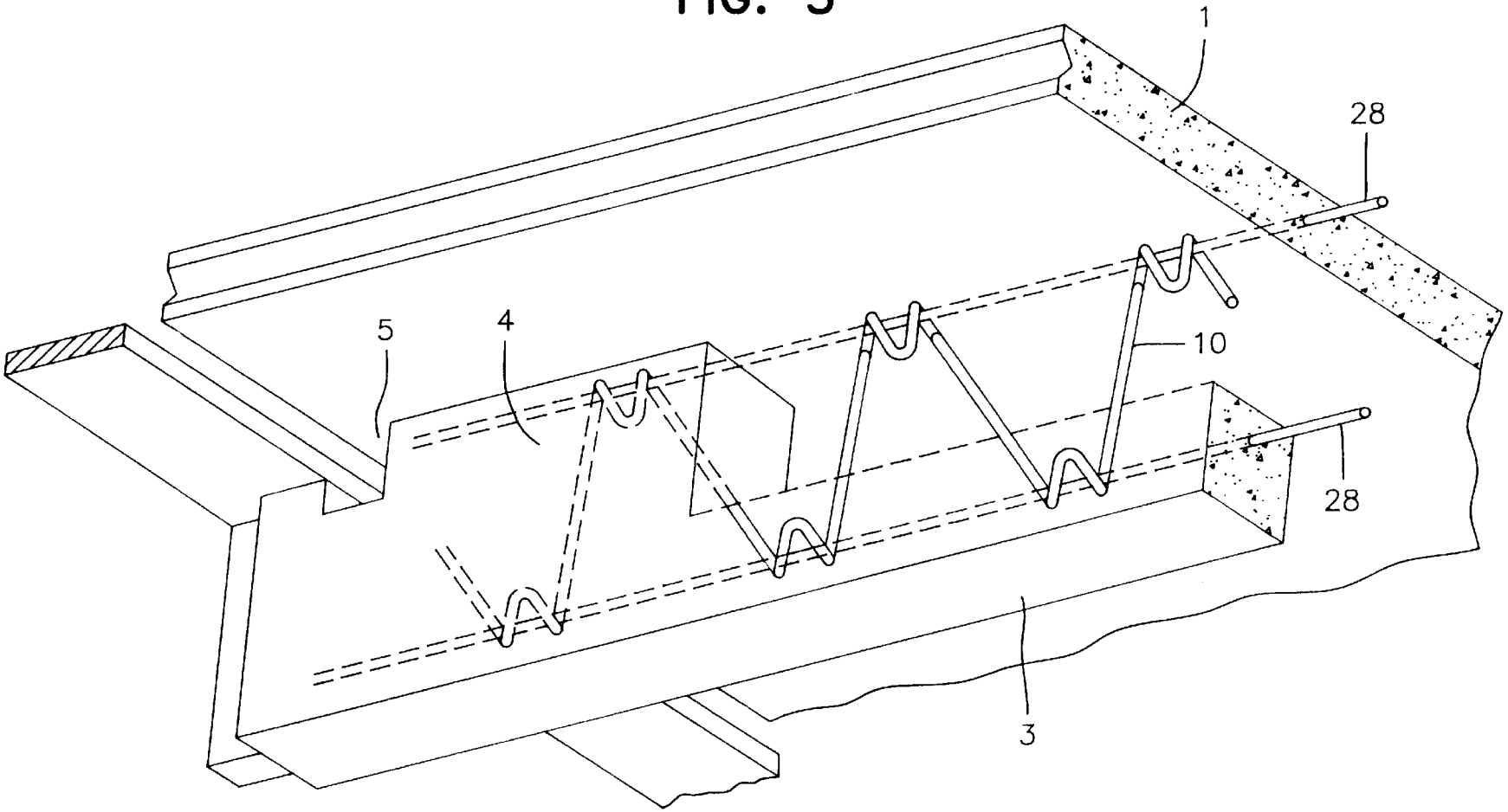
FIG. 3 illustrates a perspective view of a structural floor member supported, with a chord in a cast design (3) and web of W-, M-bent bar (10) according to the invention.
Figure 4:
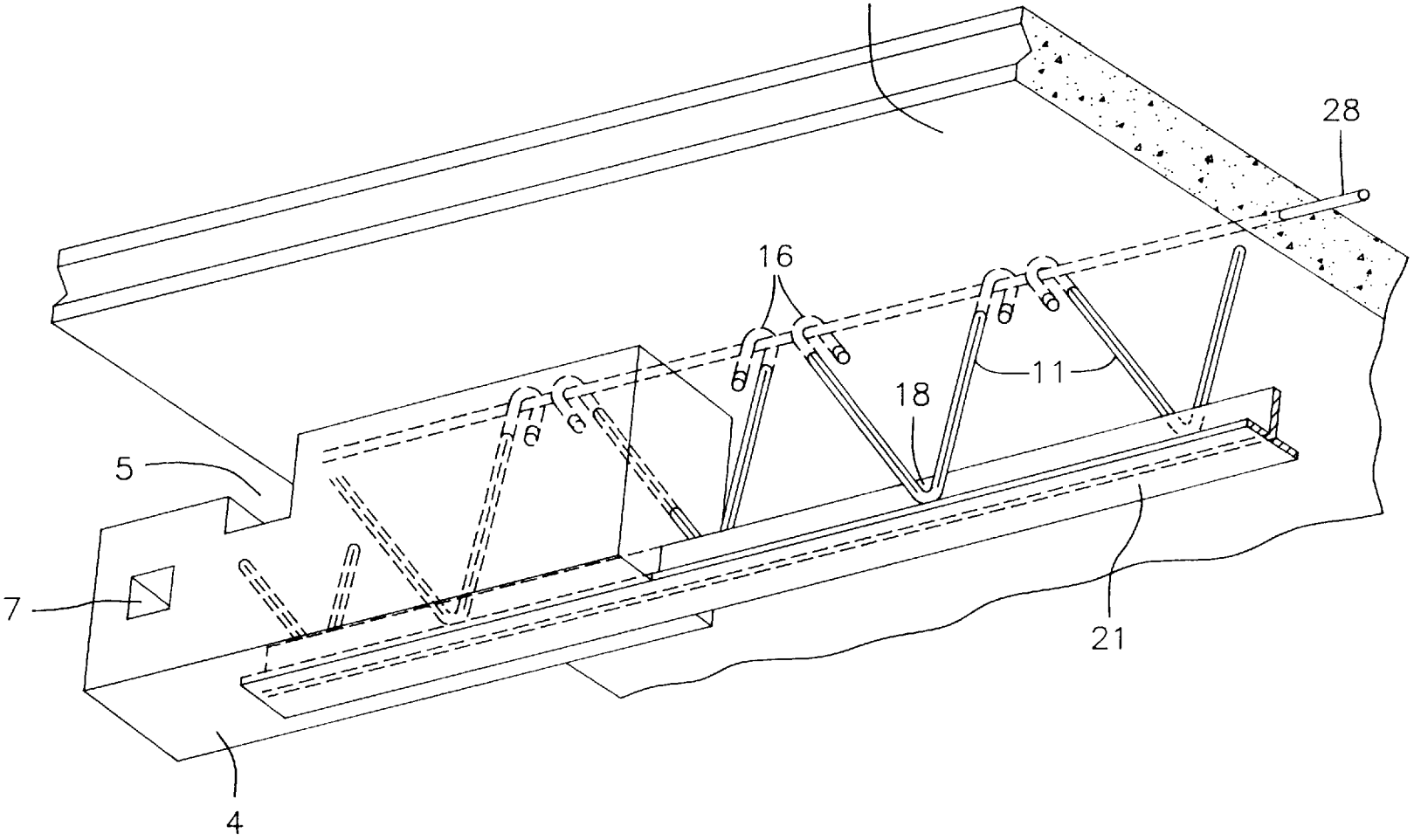
FIG. 4 illustrates a perspective view of a chord (21) of steel T-section shape and V-bent truss webs (11) according to the invention.
Figure 5:
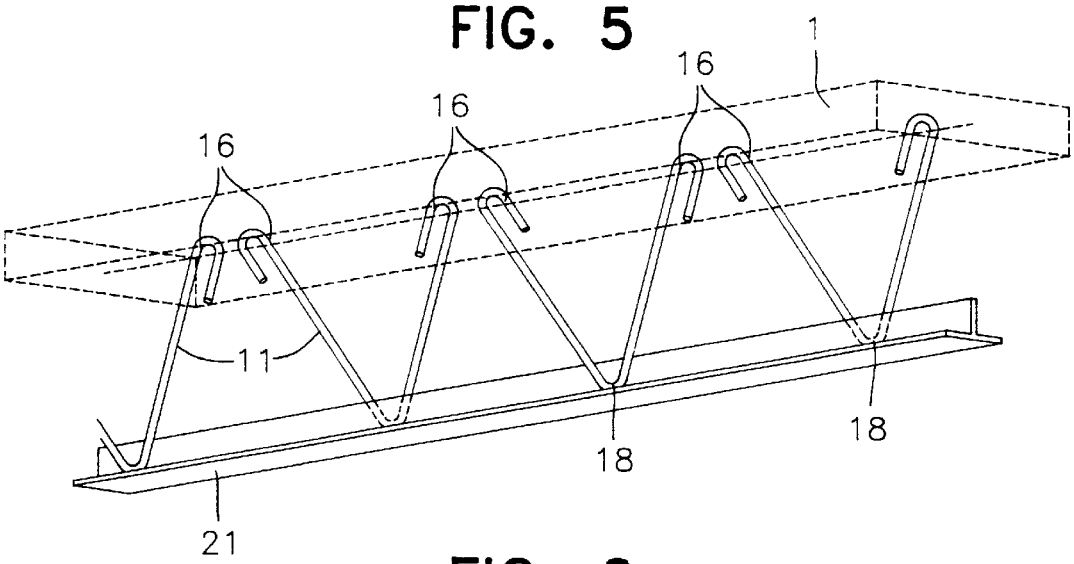
FIG. 5 illustrates a perspective view of a chord with a V-bent web (11) with perpendicular or oblique end hooks (16). A steel chord (21) of T-section shape and a wide cast chord (3) or slab (1).
Figure 6:
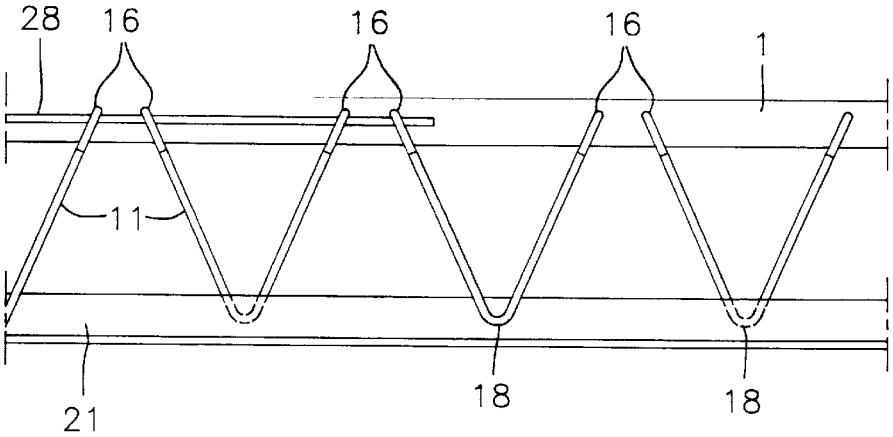
FIG. 6 illustrates a side view of a chord with V-bent web (11) with perpendicular or oblique end hooks (16) according to the invention. A flange (21) of steel is T-section shaped.

FIG. 3 illustrates a perspective of a supported structural floor member with cast slab (1), with a cast chord and with WM arrayed truss web (10).

FIG. 15 indicates how the manufacturing of the web (10) can be performed according to the invention: The basic material can be a bar, (also wire, tubing or strip) straight rolled, or coiled to a large diameter. A web, bent in one plane from the beginning, with V- or V-like bends (18) is provided with perpendicular or oblique anchor bends (15) by bending the web at least on a side close to the anchor bend around an axis which can be parallel with the chord so that one from the side seen will be VM-like or WM-like (10) in appearance, respectively, and in cross section J-bend, S-bend or C-bend, respectively, occur.

FIGS. 16A–16F illustrates a pre-cast member with cast chords with Δ-bent web member (14) and of such shape that, when seen in the longitudinal direction of the chord, it forms a zig-zag-like array. A suggestion for the manufacturing process by standard machines includes bending the truss web member in one plane, in parts, into a triangle or triangle-like shape, Δ-bent web member (14), with ends overlapping with each other in one side of the triangle, which is considered the base of the triangle, or V-bent webs (11) are used with ends provided with end hooks (16) where the end hooks from the base. The truss webs are positioned so that the bases are mainly perpendicular to the longitudinal direction of the chord and fastened to or embedded in a wide chord or slab. The ends are fastened to or embedded in the chord. In this way the webs, when seen in the longitudinal direction of the chord, from a zig-zag array. Reinforcement bars (28) can be placed in the bends in order to absorb forces and provide anchorage. An oblique part of the web wire, as seen from the side, has been formed.

FIGS. 17A–17D illustrates a cast member, with Δ-bent web member (14) according to the invention, with trusses of flanges of steel, rectangular hollow sections or double L-sections. Alternatively, metal flanges (2, 21, 22) which are not of a rounded shape, with perpendicular or oblique inside bends (15) in the slab, with straight (19) truss ends, and positioned to from that when seen in the longitudinal direction of the chord they create a zig-zag array, may be used.

FIGS. 18A–18F illustrates another example of a Δ-bent web member (14) according to the invention. In principle similar to FIG. 16 but with chords of steel with a rounded cross section (round tubes) are shown.

Figure 19A:
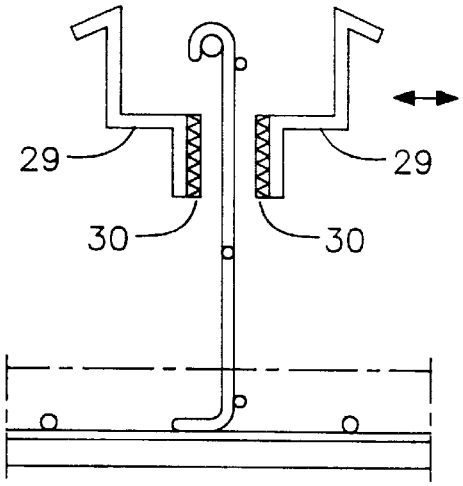
FIG. 19A illustrate a section through a divided chord mould (29) and a web (10) in position to be clamped between the mould halves by means of a ductile resilient material (30).
Figure 19B:
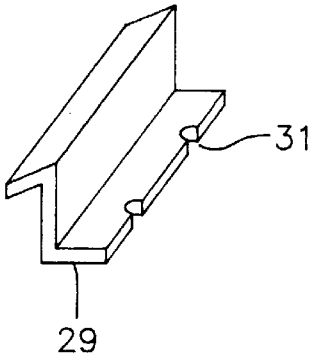
FIG. 19B illustrates a perspective view of a mould half (29) provided with notches (31) for web members.

FIG. 19A illustrates a section through a divided flange mould (29) and a web (10) in position to be clamped between the mould halves by means of a ductile resilient material (30) and in FIG. 19B, a mould half (29) with notches (31) for e.g. a web (10).

Figure 20:
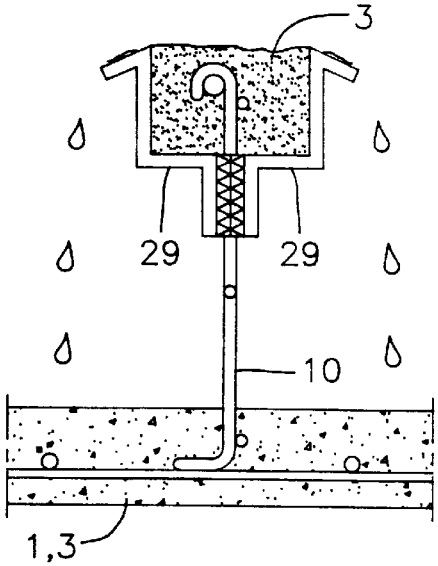
FIG. 20 illustrates a member with chords or a truss with a wide bottom chord (3) when being cast by means of equipment according to FIG. 19A.

FIG. 20 illustrates a member being cast by means of equipment according to FIG. 19.

Figure 21A:
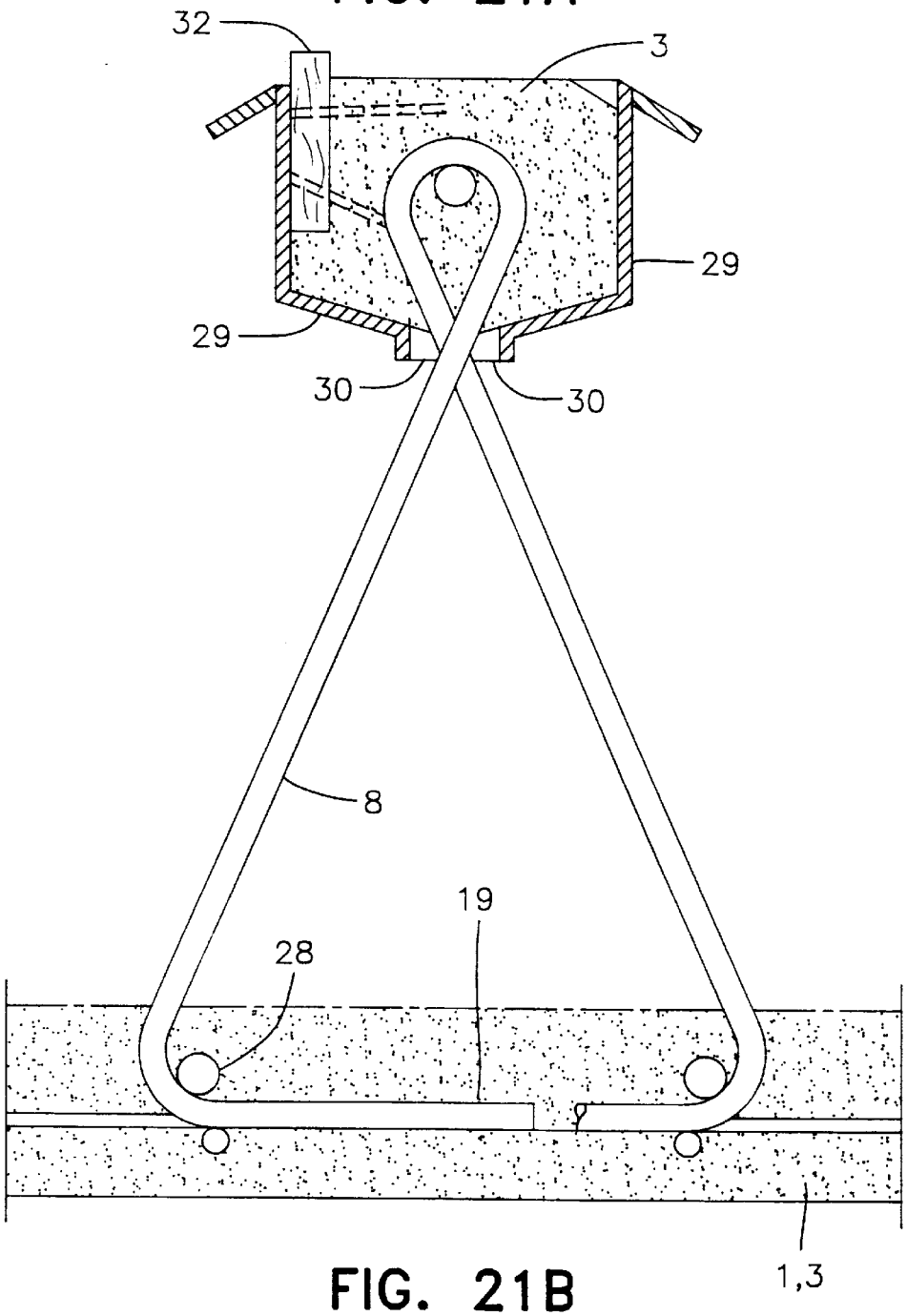
FIG. 21A illustrates cross section of a member with a web (8) when being cast by means of equipment according to FIG. 19A.
Figure 21B:
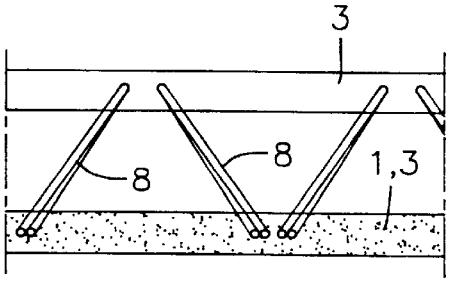
FIG. 21B illustrates an elevation of a member with a web (8) according to FIG. 21A.

FIG. 21A illustrates a cross section of an element with a web Δ &-bent (8) when being cast by means according to FIG. 19, and FIG. 21B illustrates in elevation a member with a web (8) according to FIG. 21A. Also shown in a nailable or screwable device (32) for fastening of rigid boards, e.g. gypsum boards in a ceiling, plywood, particle board floor, joists, or suspension devices, which can be resilient for sound insulation. The example shows a wooden board. Also resilient profiles (32) of e.g. folded sheet steel for sound attenuation can be directly embedded in the same way.

Figure 22A:
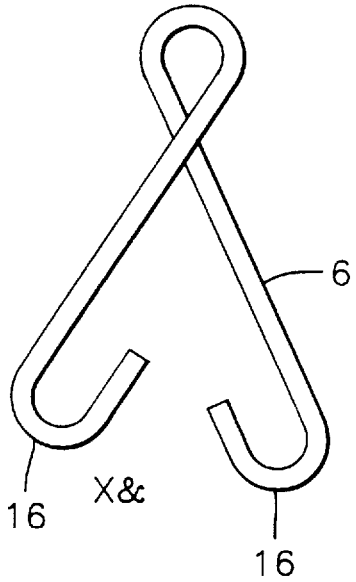
FIGS. 22A–22D illustrate views of X &-bent (6) (FIG. 22A), XJ&-bent (7)(FIG. 22B), Δ&-bent (8) (FIG. 22C), L&-bent (9) (FIG. 22C) truss web according to the invention.
Figure 22B:
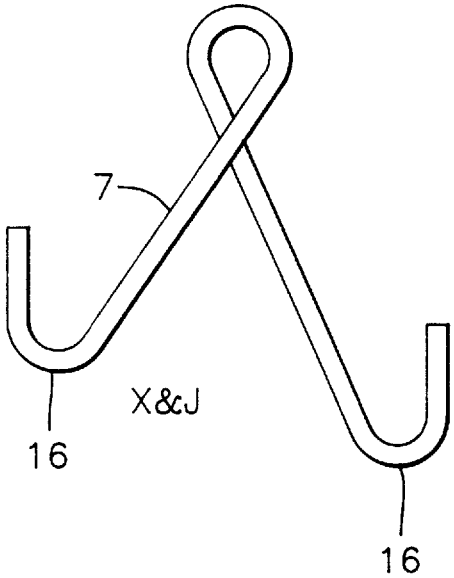
Figure 22C:
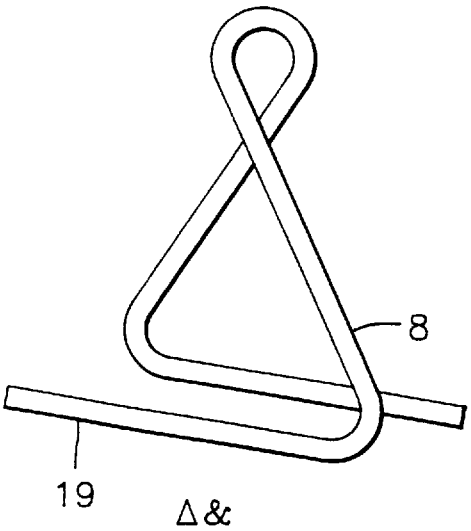
Figure 22D:
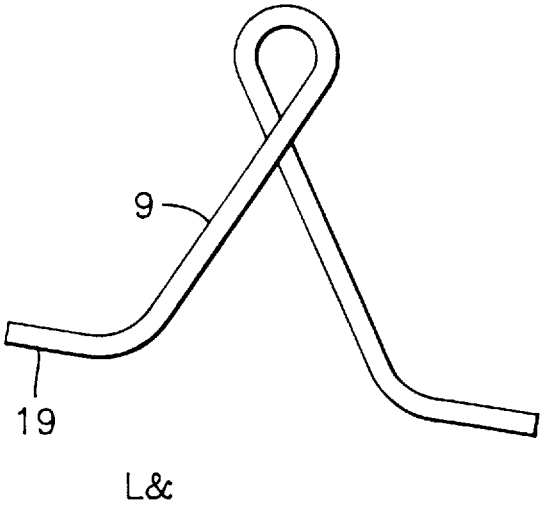

FIGS. 22A, B, C and D illustrate views of X&-bent, XJ&-bent, Δ&-bent, L&-bent (9) webs, respectively, according to the invention. Bent as webs above, for example V-bent or Δ-bent with an inside bend formed into a loop for embedding into a chord (3), with crossing web wires at the edge of the chord facing the slab (1) or the other chord (3), possibly somewhat wider.

The bending of the above webs can, or course, be made in another sequence.

Even if in essential parts only a few of the design options of the present invention have been shown in the drawings and described above, it should be understood that the invention is not restricted to these designs but are only limited by the claims.

I claim:

1. A truss assembly comprising:

two elongated members separated from each other, a web assembly extending between said two elongated members and being partially embedded in said two elongated members, said web assembly including a plurality of separated web members having separate parts bent and embedded in said elongated members in such form that when seen in a longitudinal direction, said web members form a zig zag array inclined at an angle with respect to an adjacent web member in relation to a longitudinal direction of said two elongated members for avoiding torsional stresses, said web members being spaced along and embedded partially in said two elongated members along a length of said two elongated members, said web members each including a perpendicular or oblique extending portion in relation to the longitudinal direction of said two elongated members, two ends of each of said web members each end including a bend terminating in a straight shank portion and a free end portion embedded in a same one of said elongated members, each of said web members including a portion opposite to said two ends, said portion being embedded in the other of said elongated members and having an inner bend formed in a crossed, enclosed loop, said web assembly including web members having a shape which is created by bending a web portion, in one plane with V-shaped-bends in a zig zag array by bending the web portion, at least on one side, to include the V-shaped-bends.

2. The truss assembly according to claim 1, wherein each of said web members include one substantially straight bar with end hooks situated in a same plane, bent towards each other or in a same direction forming an S-shape and each of said web members is bent once more with said inner bend in another plane from said end hooks, into a V-shape.

3. Arrangement for manufacturing a castable truss comprising a mould for casting of a top chord of a truss, said mould being divided into halves having notches for fitting around web wires to provide a seal between the mould halves, said mould halves including resilient material on at least one of said mould halves, which resilient material when pressed together, is compressed and shaped around the web wires.

* * * * *